United States Patent [19]

Haker et al.

[11] 4,187,036

[45] Feb. 5, 1980

[54] VIBRATION CONTROL FOR ASPHALT ROADWAY COMPACTOR

[75] Inventors: Edwin J. Haker, Elm Grove; Charles F. Riddle, Brookfield; Ralph F. Bielinski, South Milwaukee, all of Wis.

[73] Assignee: Rexnord Inc., Milwaukee, Wis.

[21] Appl. No.: 940,416

[22] Filed: Sep. 7, 1978

[51] Int. Cl.[2] ..... E01C 19/38

[52] U.S. Cl. ..... 404/117; 307/123; 180/77 H

[58] Field of Search ..... 404/117, 122, 123; 307/9, 117, 122, 123; 180/77 H

[56] References Cited

U.S. PATENT DOCUMENTS

| | | | |
|---|---|---|---|
| 3,543,656 | 12/1970 | Roettger | 404/117 |
| 3,605,583 | 9/1971 | Keppler | 404/117 |
| 3,797,954 | 3/1974 | Harris | 404/117 |
| 3,901,617 | 8/1975 | Herbst | 404/117 |

*Primary Examiner*—Nile C. Byers, Jr.

[57] ABSTRACT

A dual roll vibratory compactor is provided with a single lever control for initiating travel in either direction and then starting the rotation of the eccentric weights to vibrate the rolls. Either or both rolls vibrate at low or high selected frequencies according to travel direction. A mode control switch is provided to provide the desired selections. A switch for reversing the selections is provided to maintain the same selections when the compactor is turned around.

5 Claims, 6 Drawing Figures

Fig. 1
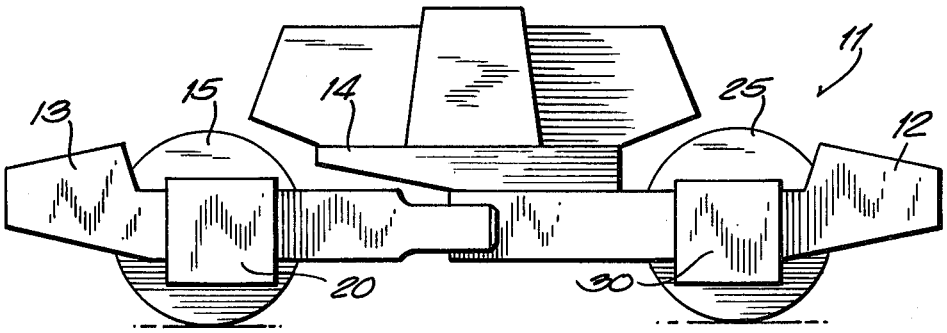
Fig. 2.
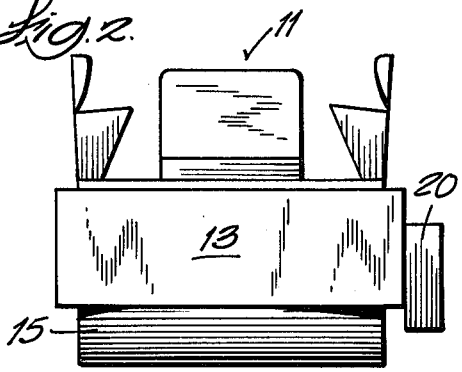
Fig. 3
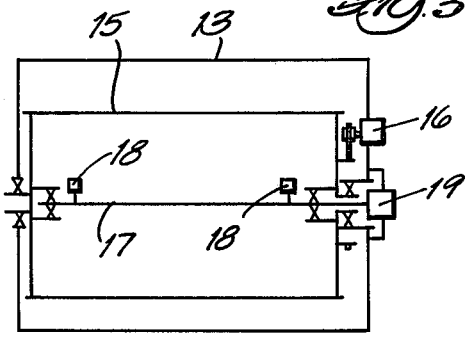
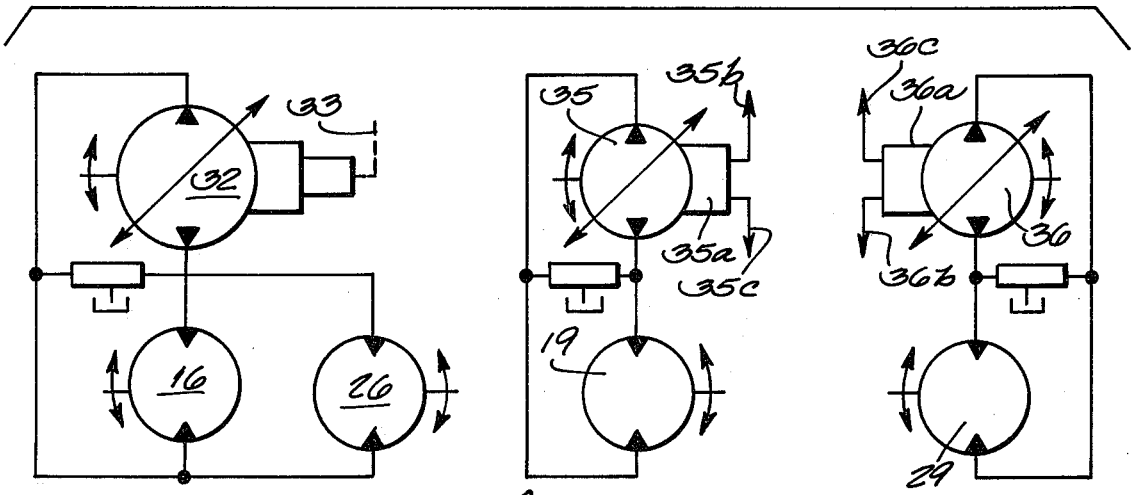
Fig. 4

VIBRATION CONTROL FOR ASPHALT ROADWAY COMPACTOR

BACKGROUND OF THE INVENTION

In preparing an asphalt road, the hot asphalt is placed on the roadway by a "paver" which moves along as it spreads the asphalt. The asphalt must then be rolled while it may still be compacted, that is, before it has become too cool. Generally, with a single roll compactor several passes over each section are required toward and away from the paver. A heavy dual roll compactor can provide the required compaction of each area with a single pass toward the paver and a return pass.

Vibrating the rolls of a single or dual roll compactor is especially effective in its compacting effect. However, the vibration must be adjusted so that it also is not over-effective and does not leave roll marks in the asphalt surface.

It is the practice only to start the vibration after the compactor has started its travel and also to reverse the rotation of the eccentric weights when the direction of travel is reversed. Ideally, the first roll over the asphalt should be with only the required vibration and each successive roll should vibrate with a successively higher frequency. With a dual roll compactor there are four such rolls in the two passes mentioned. Their respective adjustments for each pass and such a sequence have heretofore not been provided for. As one complication, it should be mentioned that one side of the compactor is preferably provided with a minimum of overhang so that the machine can reach and compact to one edge of the roadway and then to the other edge as well by reversing the machine respecting the location of the paver. Such a reversal would require reversing whatever adjustments have been made.

The object of the present invention is to provide a frequency sequence selection which may be also reversed when the machine is reversed.

SUMMARY OF THE INVENTION

A dual roll compactor has several frequency settings, a mode control switch which provides a choice of several frequency sequences for each pass toward the paver and return and a switch by which the sequences may be reversed respecting the paver when the machine is so reversed.

BRIEF DESCRIPTION OF THE SEVERAL VIEWS OF THE DRAWINGS

FIG. 1 is a side elevation of a dual vibratory roll compactor.

FIG. 2 is a front elevation of the compactor shown in FIG. 1.

FIG. 3 is a line drawing showing in plan the frame and the rotating weights of one of the rolls and the separate hydraulic motors which rotate the weights and the roll.

FIG. 4 shows with symbols the basic elements of the hydraulic circuits for driving the rolls to effect machine travel and the hydraulic circuits for rotating the eccentric weight within each roll to effect its vibration. The arrows show the electrical leads to the motors for the analog voltages which control the rotational speed and direction of the eccentric weights.

FIG. 5 shows the basic elements of the electrical circuits which provide selectively the analog voltages referred to.

DESCRIPTION OF THE PREFERRED EMBODIMENT SHOWN IN THE DRAWINGS

Figure 6:
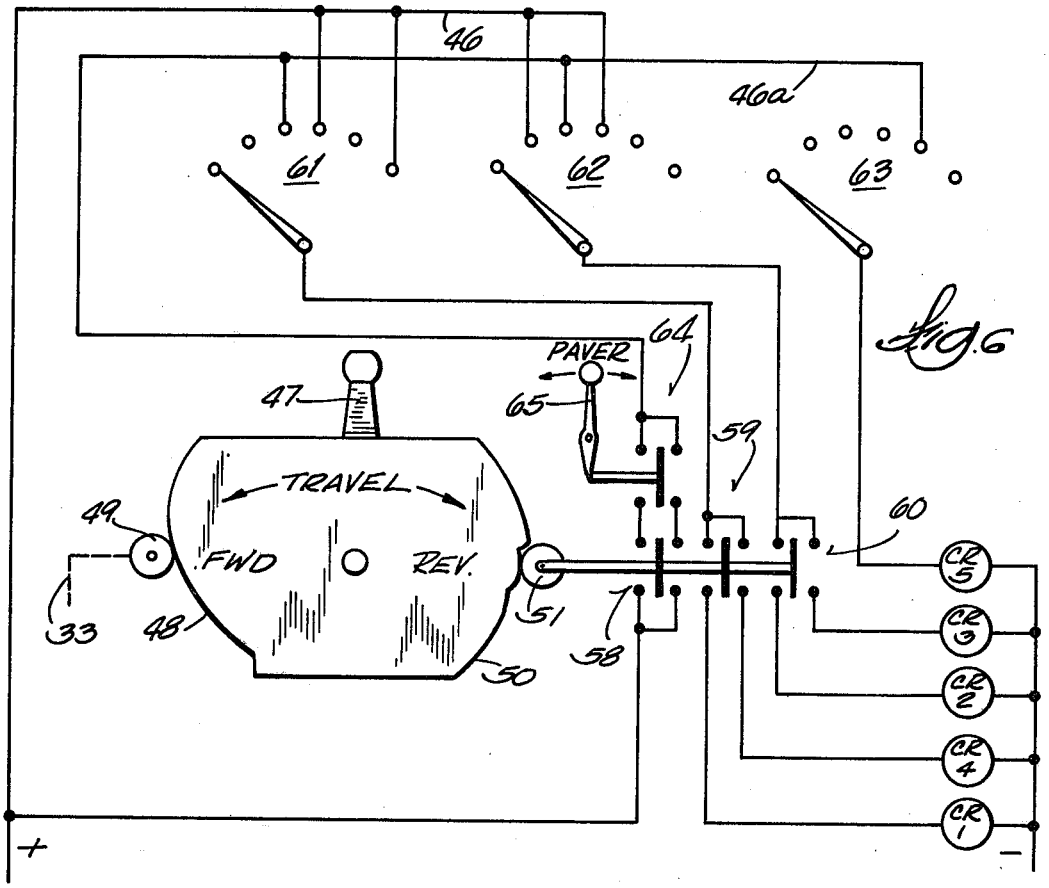
FIG. 6 shows the basic elements of the manual controls and circuits which selectively energize the relays operating the switches of FIG. 5.

The machine 11 shown in FIGS. 1–3 includes the rear frame 12, and the forward frame 13. The two frames are pivotally connected at the center of the machine for steering and the operator's and engine platform 14 is carried by frame 12 over the center of the machine whereby the machine may have the same operation in either direction.

The forward roll 15 is shown with its drive in FIG. 3. It supports frame 13 through suitable outboard bearings and suitable resilient cushion means, not shown. The hydraulic motor 16 carried by frame 13 drives the roll in either direction through suitable transmission means. The roll 15 also supports the shaft 17 through suitable inboard bearings. Shaft 17 carries an eccentric weight 18 near each bearing and projects from one side of the roll. The projecting end of shaft 17 is connected to the hydraulic motor 19. Motor 19 is supported by frame 13 at one side of the machine and rotates shaft 17 in either direction to effect vibration of roll 15. The motor 16 with its transmission means and the motor 19 are enclosed by the housing 20 at the left side of machine 11 as shown.

The rear roll 25 similarly supports the rear frame 12 and is driven in either direction by the hydraulic motor 26 through similar transmission means. Eccentric weights, not shown, similarly effect vibration of roll 25 and are rotated by the hydraulic motor 29. Motor 26 with its transmission means and motor 29 are enclosed by the housing 30 which is also at the left side of the machine, as shown. The arrangement of these drive components allows the other side of the machine to have a minimum of overhang whereby the rolls may reach the edge of the roadway to be compacted. The machine is thus fully reversible so that either edge of the roadway may be similarly compacted.

The basic elements of the hydraulic circuits including motors 16 and 26 and including motors 19 and 29 are shown in FIG. 4. The motors 16 and 26 are connected in parallel with the variable displacement reversible discharge pump 32 which is driven by the engine of machine 11. The discharge direction and displacement of pump 32 is controlled by a linkage 33 shown by the broken line. Each motor 19 and 29 is connected to a variable displacement, reversible discharge pump which is driven by the engine of machine 11. As shown, the pump 35 driving motor 19 has a high impedance control device **35*a* which regulates the displacement and discharge direction of the pump in response to the polarity and voltage of the electric current impressed on the device through the leads 35*b* and 35*c*. Such analog devices are in common use and generally operate with D.C. voltages of from 0 volts to +7 volts and such that there is no pump output at zero voltage. Motor 29 is similarly driven by the pump 36 having a control device 36*a* with the leads 36*b* and 36*c*. As will be described, a positive (or less negative) potential at leads 35*b* and 36*b* will cause the motors to rotate the weights in the desired direction when the machine is travelling forward; for the reverse travel direction, a positive (or less negative) potential is applied to leads 35c and 36c**.

Figure 5:
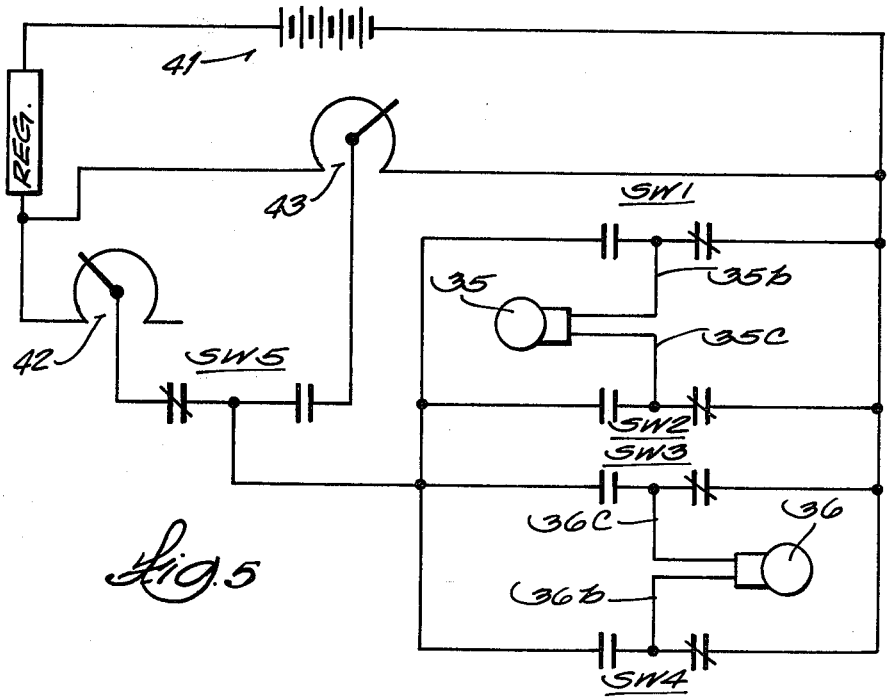

The two adjustable voltage sources shown in FIG. 5 are connected in parallel to the battery 41 and the voltage regulator 42 and comprise the two potentiometers 42 and 43. Adjustable resistances for trim are not shown. Switches SW1 through SW5 are two-way relay-operated switches each having a common terminal, a normally open terminal and a normally closed terminal. Leads 35b, 35c, 36b, and 36c are connected respectively to the common terminals of switches SW1 through SW4. The normally closed terminals of SW1 through SW4 are connected to the negative terminal of battery 41. The normally open terminals of SW1 through SW4 are connected to the common terminal of SW5; the normally closed terminal of SW5 is connected to the wiper of potentiometer 42 which provides a first adjustable voltage source. The normally open terminal of SW5 is connected to the wiper of potentiometer 43 which provides an alternate adjustable voltage source which may be of a higher range. That is, potentiometer 42 may be set to provide the desired low frequency vibration of the rolls and potentiometer 43 may be set to provide the desired high frequency vibration of the rolls. Switches SW1 through SW5 are operated respectively by the control relays CR1 through CR5 shown in FIG. 7. One terminal of each of the control relays is connected to the negative ground line 45. The other terminal of each is selectively connected through several switches either to the positive line 46 or the line 46a as will be described.

Travel lever 47 shown in FIG. 6 is carried by machine 11 so that forward movement of lever 47, i.e. to the left as in FIG. 6 is toward the front end of machine 11, i.e. to the left in FIG. 1 and so that rearward movement of lever 47, i.e. to the right in FIG. 6 is toward the rear of machine 11, i.e. to the right in FIG. 1.

With reference to FIG. 6, movement of the operator's single control "travel" lever 47 to the left as shown causes the cam 48 to move roller 49 to the left. Roller 49 is connected to linkage 33 and its movement controls pump 32 to cause machine 11 to travel forwardly. Lever 47 also rotates the stepped cam 50 to move roller 51 to the left after travel of the machine has been initiated. Movement of lever 47 rearwardly respecting machine 11 similarly in effect causes the machine to travel rearwardly and cam 50 similarly moves roller 51 to the right as shown after rearward travel of the machine is initiated. Roller 51 operates the two-way switches 58, 59 and 60.

The switches 58, 59 and 60, the manually operated multi-position switches 61, 62 and 63 and switch 64 selectively connect the control relays with lines 46 and 46a. The uncommon terminals of switch 58 are connected to those of the switch 64. Line 46a is connected to the common terminal of switch 64 which is operated by the "paver" lever 65. Lever 65 is carried by machine 11 for movement by the operator as follows. If the paver is forwardly of machine 11, i.e. to the left as shown in FIG. 1, lever 65 is moved forwardly respecting machine 11, i.e. to the left as shown in FIG. 1. If machine 11 is reversed respecting the paver, i.e. if the paver is to the right of machine 11 as shown in FIG. 1, lever 65 is moved rearwardly respecting the machine, i.e. to the right as shown in FIG. 6. The operation of switches 58 and 64 is such that if lever 65 is positioned toward the paver, line 46a is disconnected from line 46 when the machine is travelling toward the paver as indicated by lever 65; line 46a is connected to line 46 only when the machine 11 is travelling away from the paver as indicated by lever 65.

The movable contacts of switches 61, 62 and 63 are operated by a common shaft and together comprise a "mode switch" having a number of positions which allow the same number of selections. Said positions and selections will be considered clockwise as modes A through F. The fixed contacts of the switches are connected to lines 46 and 46a as follows:

| SWITCH | MODE | LINE |
|---|---|---|
| 61 | CDE | 46a |
| | F | 46 |
| 62 | C | 46a |
| | BDEF | 46 |
| 63 | EF | 46a |

The common terminals of switches 58, 59 and 60 are respectively connected to line 46 and to the movable contacts of switches 61 and 62. The uncommon terminals of switches 59 and 60 are connected to the control relays as follows: when lever 47 has been moved to the left as shown for forward travel, CR1 and CR3 are connected respectively to the movable contacts of switches 61 and 62; when lever 47 has been moved to the right as shown for rearward travel, CR4 and CR2 are respectively connected to the movable contacts of switches 61 and 62.

Control relay CR5 is connected to the movable contact of switch 63 and operation of the voltage switches by the relays may be tabulated as follows (to the left being forward and to the right being rearward as to machine 11):

| | Lever 65 to Left (Paver is forward of machine) | | | | | |
|---|---|---|---|---|---|---|
| | Lever 47 to Left (Forward Travel) | | | Lever 47 to Right (Rearward Travel) | | |
| A | | | | | | |
| B | | SW3 | | SW2 | | |
| C | | | | SW2 | SW4 | |
| D | | SW3 | | SW2 | SW4 | |
| E | | SW3 | | SW2 | SW4 | SW5 |
| F | SW1 | SW3 | | SW2 | SW4 | SW5 |

| | Lever 65 to Right (Paver is rearward of machine) | | | | |
|---|---|---|---|---|---|
| | Lever 47 to Left (Forward Travel) | | | Lever 47 to Right (Rearward Travel) | |
| A | | | | | |
| B | | | SW3 | SW2 | |
| C | | SW1 | SW3 | | |
| D | | SW1 | SW3 | SW2 | |
| E | SW5 | SW1 | SW3 | SW2 | |
| F | SW5 | SW1 | SW3 | SW2 | SW4 |

With reference to the vibration of the rolls 15 and 25 in their leading or trailing positions, the modes are then as follows:

| Travel: | | Toward Paver | | Away From Paver | |
|---|---|---|---|---|---|
| Roll: | | Lead | Trail | Trail | Lead |
| Mode | A | — | — | — | — |
| | B | — | Low | Low | — |
| | C | — | — | Low | Low |

-continued

| Travel: | Toward Paver | | Away From Paver | |
|---|---|---|---|---|
| Roll: | Lead | Trail | Trail | Lead |
| D | — | Low | Low | Low |
| E | — | Low | High | High |
| F | Low | Low | High | High |

The steering control (not shown) of machine 11 and levers 47 and 65 are, of course, located on the platform 14 of machine 11 where they are readily within reach of the operator when he is seated at either side of the machine as is provided for. Potentiometers 42 and 43, switches 61–63 and lever 65 are preferably similarly located. Mode A is provided particularly for moving the machine from site to site. In Mode B the trailing roll only vibrates in either direction. In Mode B machine 11 may travel toward the paver and away from the paver over another area. In Mode C both rolls vibrate only when the machine travels in the direction away from the paver. Modes D, E and F provide progressively more vibration at the selected frequency settings. The frequency settings do not have to be reset when machine 11 is turned around whenever required. Resetting of paver lever 65 is all that is required to reverse the modes when the machine is so reversed.

Various other modes may be provided as desired and various embodiments of the invention may be carried out within the scope of the accompanying claims.

We claim:

1. In a dual roll vibratory compactor for operation in conjunction with a roadway paver, each roll of the compactor being provided with vibration control means having several frequency settings, said means having a mode control switch which provides a choice of at least two different frequency sequences for each pass of the compactor toward the paver and return, said means further having a switch which reverses said sequences whereby they may be reversed respecting the compactor such as when the compactor is reversed respecting the paver.

2. In a power driven and propelled, steerable two directional road compaction machine having two vibratory rolls for travel over and return over the laid material and having a steering control, a drive mechanism for each roll, a vibration mechanism for each roll having a number of adjustable vibration frequency settings (zero and one or more), and a lever operatively connected to and controlling said mechanisms such that lever movement in either direction first determines the direction and speed of machine travel and then initiates the vibration of the two rolls each at a set frequency; the improvement comprising a first single lever control means providing a plurality of frequency sequence selections (two or more) for each of the two rolls traveling over and back over the laid material, and a second single lever control means which reverses the selected frequency sequence.

3. In the machine of claim 2 wherein the roll drive and vibration mechanisms project only to one side of the machine whereby the machine has a limited overhang on the other side, said first and second control means particularly allowing the machine to be turned around for close work on either side as desired.

4. A self-propelled dual vibratory roll roadway compactor having a single lever operator's control which initiates travel in a forward or reverse direction and thereupon through an electrical system initiates the desired vibration of the two rolls, each roll having a drive motor and a motor which effects such vibration, said control being connected to said motors to control their operation as aforesaid; said electrical system including (1) a speed control for each motor which determines the frequency level of roll vibration including at least one adjustable level and a zero frequency level, there is no vibration, (2) sets of switches operated by said operator's control and (3) a mode control switch having means selectively connecting said motors and speed controls through said sets of switches whereby the forward and rear rolls are vibrated respectively at selected levels when the machine travels forwardly and whereby the rear and forward rolls are vibrated respectively at selected levels when the machine travels rearwardly, said means including a reversing switch connected to said several switches to reverse said connections whereby when the machine travels rearwardly the rear and forward rolls are vibrated respectively at said first mentioned selected levels and when the machine travels forwardly the forward and rear rolls are vibrated respectively at the second mentioned selected levels.

5. A self-propelled dual vibratory roll roadway compactor having a single lever control which initiates travel in a forward or reverse direction and thereupon through an electrical system initiates the desired vibration of the two rolls, each roll having a drive motor and a motor which effects such vibration, said control being connected to said motors to control their operation as aforesaid; said electrical system including (1) a speed control for each motor which determines the frequency level of roll vibration in response to a control voltage, sources of control voltages including at least one adjustable control voltage and a voltage providing a zero frequency level, that is no vibration, (2) first and second sets of switches operated by said lever, the first set being closed by lever control movement which initiates forward travel of the machine and the second set being closed by movement of the lever control which initiates reverse travel of the machine, and (3) a mode control switch having means selectively connecting selected voltage sources with said speed controls through said first set of switches whereby the forward and rear rolls are vibrated respectively at selected levels when the machine travels forwardly, said mode control switch also having means connecting selected voltage sources with said speed controls through said second set of switches whereby the rear and forward rolls are vibrated respectively at selected levels when the machine travels rearwardly, said means including a reversing switch connected to said other switches to reverse said connections whereby the rear and forward rolls are vibrated respectively at said first mentioned selected levels when the machine travels rearwardly and the forward and rear rolls are vibrated respectively at the second mentioned selected levels when the machine travels forwardly.

* * * * *